United States Patent [19]

Thielenhaus

[11] Patent Number: 4,519,170

[45] Date of Patent: May 28, 1985

[54] METHOD OF AND APPARATUS FOR HOLDING A SHAFT DURING FINISH GRINDING

[75] Inventor: Ernst Thielenhaus, Wuppertal, Fed. Rep. of Germany

[73] Assignee: Ernst Thielenhaus KG, Wuppertal, Fed. Rep. of Germany

[21] Appl. No.: 546,509

[22] Filed: Oct. 28, 1983

[30] Foreign Application Priority Data

Oct. 30, 1982 [DE] Fed. Rep. of Germany ..... 3240332

[51] Int. Cl.[3] ..... B24B 1/00

[52] U.S. Cl. ..... 51/289 R; 51/67; 51/103 R; 51/236; 51/237 R

[58] Field of Search ..... 51/67, 103 R, 103 C, 51/131.2, 289 R, 236, 237 R

[56] References Cited

U.S. PATENT DOCUMENTS 2,354,296 7/1944 Arms ..... 51/237 R

FOREIGN PATENT DOCUMENTS 1266921 6/1961 France ..... 51/236

*Primary Examiner*—Frederick R. Schmidt
*Assistant Examiner*—J. T. Zatarga
*Attorney, Agent, or Firm*—Karl F. Ross; Herbert Dubno

[57] ABSTRACT

A workpiece having a generally cylindrical outer surface centered on an axis is machined by first closing a pair of journal halves having generally semicylindrical inner surfaces of slightly greater diameter than the outer workpiece surface around the workpiece. Then a fluid is pumped under superatmospheric pressure into the space between the journal inner surface and the workpiece outer surface so as to support the workpiece in the journal halves on the liquid generally out of contact with the inner surfaces thereof. The thus supported workpiece is rotated about its axis and a finishing tool is engaged radially against it. The average radial distance between the journal inner surface and workpiece outer surface when the journal halves are closed on the workpiece is equal to more than the sum of the radial deviations of these surfaces from a perfect cylinder. The workpiece is rotated by axially engaging it between a pair of rotatable elements and rotating at least one of the elements.

11 Claims, 4 Drawing Figures

METHOD OF AND APPARATUS FOR HOLDING A SHAFT DURING FINISH GRINDING

FIELD OF THE INVENTION

The present invention relates to the finish-grinding or superfinishing of a shaft. More particularly this invention concerns a method of and apparatus for holding a driveshaft or the like as it is finish ground.

BACKGROUND OF THE INVENTION

In order to give a precise cylindrical finish to a shaft such as a driveshaft it is necessary to hold the semifinished shaft at two locations for rotation about its axis, apply torque to the shaft to rotate it, and press a finishing tool or stone radially inward against it. The workpiece must be supported quite solidly, so that its axis does not move as it is rotated, since the tool must press against it with enough force to grind or mill off high spots.

The standard procedure either uses lathe-type centers between which the workpiece is engaged axially, or chucks with three or more jaws that radially engage the workpiece surface. Both systems require extremely careful setup, with the holder axes aligned as perfectly as possible with that of the workpiece. A deformation in the workpiece at the held location can put the entire grinding operation offcenter. Similarly such mechanical gripping of the workpiece inherently adds any misalignment or irregularities in the holders to those of the holder, often compounding the problem of producing a cylindrically true finished workpiece. The holding force, whether axial or radial, is normally substantial, so that this force can frequently deform a workpiece which takes on a nonround shape when it relaxes when dechucked or otherwise removed from its holder. If a shaft is to be used at high rotary speeds, it is essential that it be very accurately machined on center, so that the time spent properly setting up and finishing the workpiece can be very large.

It has been suggested in German Pat. No. 2,407,261 to machine the end of a valve plunger or roller-bearing race by fitting the workpiece via an elastic ring or layer over a drive member and centering it loosely within a cylindrical guide. A liquid is fed under pressure to the space between the inner surface of the guide and the outer surface of the workpiece to center same within each other. This type of arrangement is only considered useful in superfinishing small annular and/or short workpieces.

OBJECTS OF THE INVENTION

It is therefore an object of the present invention to provide an improved system for holding a shaft while finishing it.

Another object is the provision of such a system for holding a shaft while finishing it which overcomes the above-given disadvantages, that is which eliminates distortion of the workpiece, yet which sure and accurately holds a workpiece on center.

SUMMARY OF THE INVENTION

A workpiece having a generally cylindrical outer surface centered on an axis is machined according to the invention by first closing a pair of journal halves having generally semicylindrical inner surfaces of slightly greater diameter than the outer workpiece surface around the workpiece. Then a fluid is pumped under superatmospheric pressure into the space between the journal inner surface and the workpiece outer surface so as to support the workpiece in the journal halves on the liquid generally out of contact with the inner surfaces thereof. The thus supported workpiece is rotated about its axis and a finishing tool is engaged radially against it.

It is thus possible to use hydraulic support even for a shaft workpiece. Such style of support, which of course is applied at two axially spaced locations, ensures extremely accurate centering of the workpiece, since a localized bump or recess, even if located in the area within the holder, will have little misaligning effect.

According to another feature of this invention the average radial distance between the journal inner surface and workpiece outer surface when the journal halves are closed on the workpiece is equal to more than the sum of the radial deviations of these surfaces from a perfect cylinder. Thus binding or jamming of the workpiece in the holders is impossible.

In accordance with another feature of the present invention the superatmospheric pressure is generally at least 5 bar. The fluid is a machining oil, that is of the high-sulfur type used in thread-cutting or grinding operations.

The workpiece of this invention is rotated by axially engaging it between a pair of rotatable elements and rotating at least one of the elements. In this manner it is possible to exert considerable axial force on the workpiece, effectively preventing it from becoming radially misaligned or from shifting radially as it is being ground.

The journal inner surfaces of this invention are centered on axes that are coaxial when the journal halves are closed together, and that are coaxial with the axis of the shaft when same is supported in them. In addition the workpieces are normally passed through the grinder of this invention for production-line serial work on them. They are supported by a conveyor, for instance on standard holder blocks, with the workpiece axes slightly below the journal axis. Thus as the journal closes on the workpiece and/or when the fluid is pumped in, the workpiece is lifted off its support blocks and can be turned on center out of contact with the support. Once ground, the fluid supply is cut off and the journal halves are separated to redeposit the workpiece back on its support. As the workpiece is normally fairly true by the time it is superfinished according to this invention, it is therefore possible to work with a relatively small vertical offset between the axis of the supported workpiece and that of the closed journal to allow such operation.

The machine according to this invention therefore basically comprises a pair of journal halves having generally semicylindrical inner surfaces of slightly greater diameter than the outer workpiece surface, a drive unit for closing the halves around the outer surface of the workpiece, and a pump for pumping a fluid under superatmospheric pressure via radially throughgoing bores into the space between the journal inner surface and the workpiece outer surface and thereby supporting the workpiece in the journal halves on the liquid generally out of contact with the inner surfaces thereof. Drive elements, typically with axially confronting surfaces lying in planes perpendicular to the journal axis, are engageable with the workpiece for rotating the thus supported workpiece about its axis. A finishing tool engageable radially against the workpiece can grind the workpiece down, superfinish it, or perform another normally material-removing operation on it.

The journal halves of this invention are substantially semicylindrical and are carried on respective arms supporting the journals and rotatable about at least one axis above the journal halves in the closed position thereof. As mentioned above, supports underneath the arm axis hold the workpiece at a level with the workpiece axis slightly below the position of the centers of curvature of the journal halves. Thus when closed on the workpiece and pressurized the workpiece is lifted from the supports. When tolerances are very close, the liquid itself can provide that last bit of lift that clears the workpiece up off its support blocks, so that no direct contact need ever take place between the workpiece and the journal halves. Such a procedure gives extremely long machine life.

DESCRIPTION OF THE DRAWING

The above and other features and advantages will become more readily apparent from the following, reference being made to the accompanying drawing in which.

SPECIFIC DESCRIPTION

Figure 2:
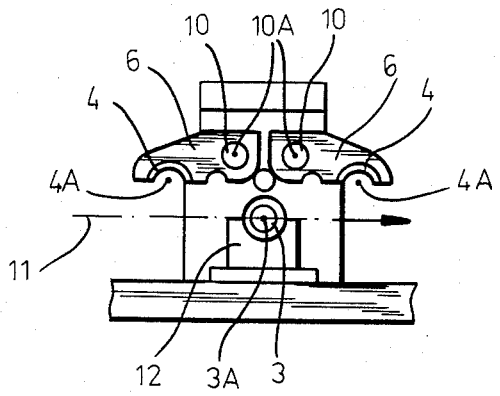
FIG. 2 is a view of a detail of FIG. 1, but not closed on the workpiece.
Figure 1:
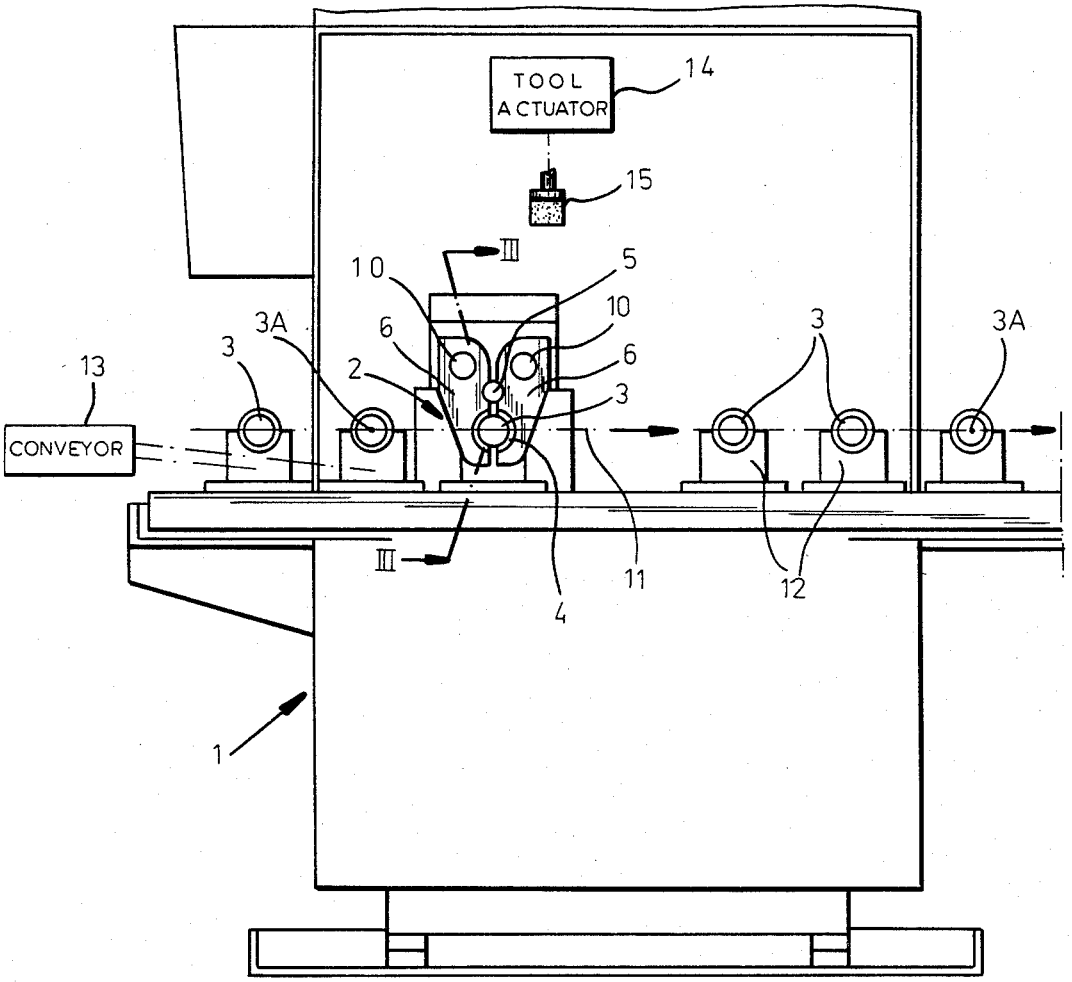
FIG. 1 is a partly diagrammatic side view of the apparatus according to this invention closed on a workpiece.

As seen in FIGS. 1 and 2 the superfinishing machine 1 according to this invention has at least one pair of holders 2 for identical workpieces 3, here drive shafts having stepped cylindrical outer surfaces 3*a* and axes 3A. The holders 2 are spaced along the horizontal axes 3A, and only one is shown here for clarity of view.

Figure 3:
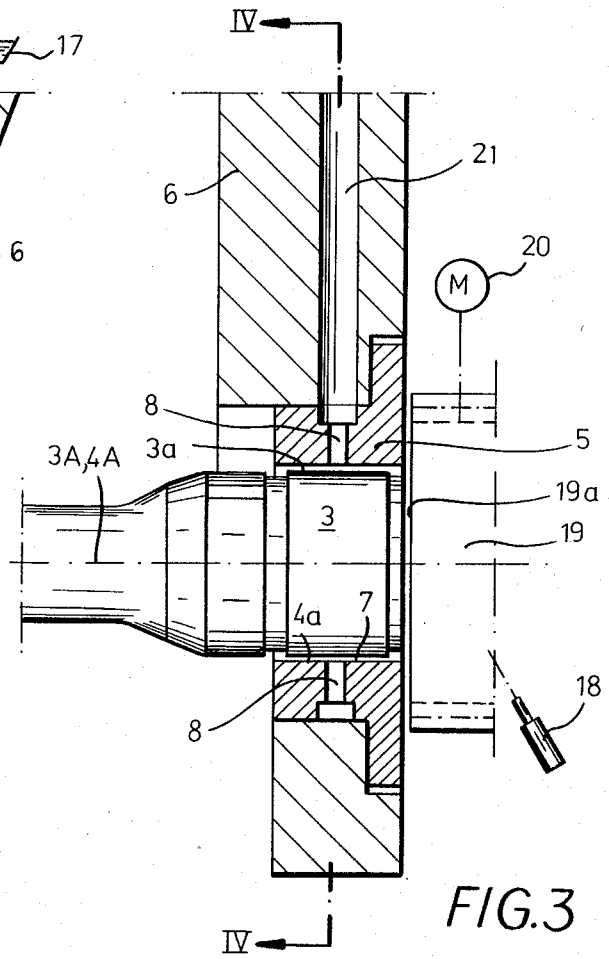
FIG. 3 is a large-scale vertical section partly in schematic form and taken along line III—III of FIG. 1.
Figure 4:
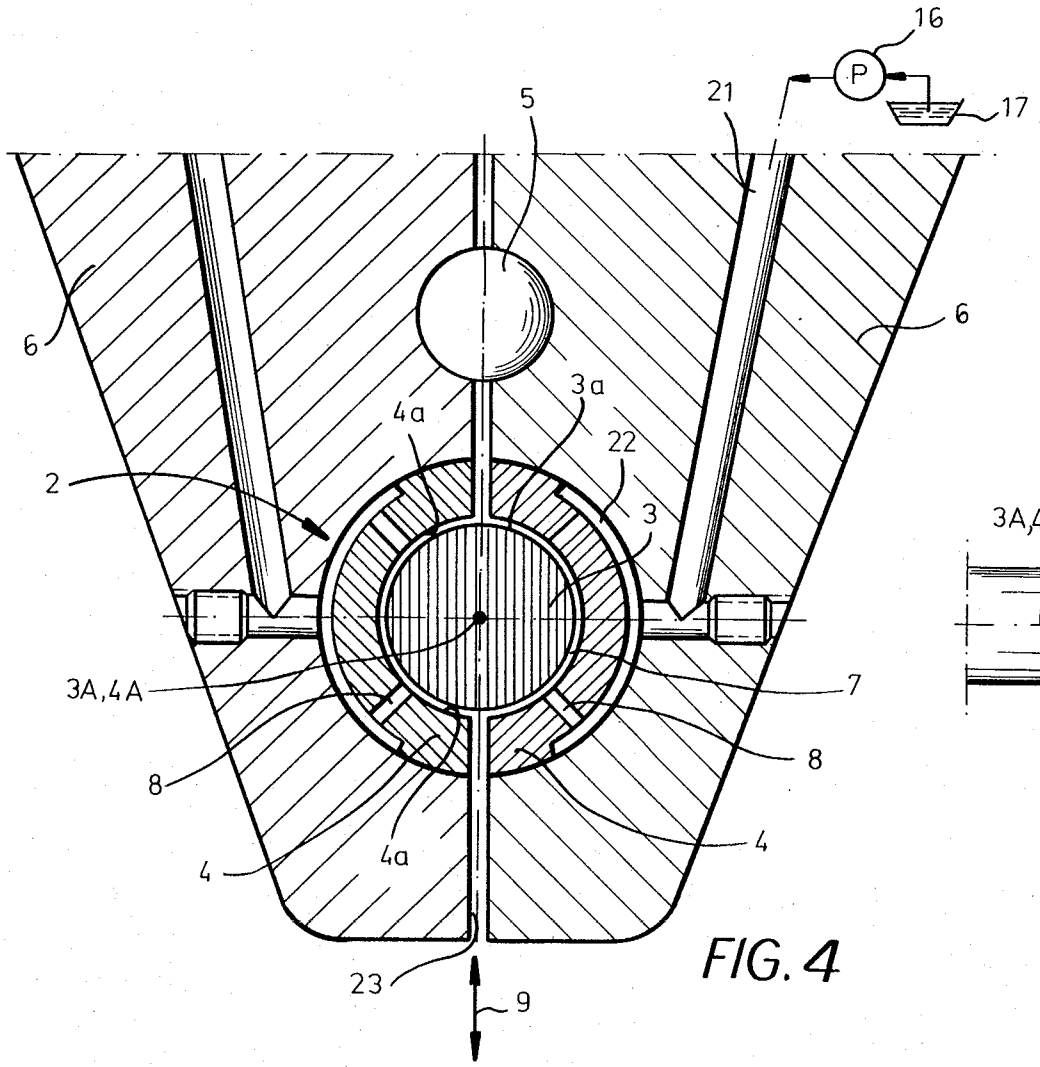
FIG. 4 is a partly schematic section taken along line IV—IV of FIG. 3.

The holders 2 according to this invention, as further shown in FIGS. 3 and 4, each have a pair of complementary and semicylindrical journal halves 4 centered on respective axes 4A and having semicylindrical inner surfaces 4*a* of slightly greater radius of curvature than the respective surfaces 3*a*. Each such journal half is held in a respective arm 6 suspended from a respective horizontal pivot shaft 10 having an axis 10A parallel to the axes 3A and 4A. The axes 10A symmetrically and horizontally flank a centering pin 5 against which the arms can fit in the closed position of FIGS. 1 and 4 with the axes 4A of both journal halves 4 coaxial.

The workpieces 3 are supported in support blocks 12 and moved by a conveyor 13 of standard construction through the machine 1 along a horizontal path 11 generally defind by the axes 3A. In the closed position of the holders 2, the axes 4A lie slightly above the path 11, so that the arms 6 can close on a workpiece 3 and lift it off its support blocks 12. This allows these workpieces 3 to be picked up by the holders according to the invention with vertical movement in the direction of arrow 9 (FIG. 4), although it is of course within the scope of the invention to provide an actuator for such vertical movement.

The journal halves 4 are formed with radially throughgoing bores 8 that open into axially extending grooves 22 formed in their outer surfaces and communicating in turn with passages 21 formed in the repsective arms 6. A pump 16 supplies a liquid lubricant, a sulfur-based grinding oil being excellent, under a pressure of about 5 bar to these passages 21. This fluid therefore fills the annular gap 7 between the inner journal-half surfaces 4*a* and the outer workpiece surface 3*a*, coaxially aligning the axes 3A and 4A. The fluid can run out the gap 23 between the confronting faces of the arms 6 and journal halves 4 and be recirculated. The radial dimension of the gap 7 is greater than the maximum radial variation of the surfaces 3*a* and 4*a* so that the workpiece 3 cannot jam in the holder 2.

Once thus supported on an annular cushion of fluid at both its ends, the shaft 3 is engaged axially between the planar end surfaces 19*a* of a pair of drive elements 19 at least one of which can be displaced axially by a cylinder 18 or the like and at least one of which also is rotated about the axes 4A by a motor 20. This action therefore axially arrests the shaft 3, whose end faces by this stage of production are perfectly perpendicular to the axis 3A.

The rotating shaft 3 is then engaged radially by at least one stone or tool 15 displaced radially into engagement with it by an actuator such as shown schematically at 14 in FIG. 1. This allows it to be finished with great accuracy. Of course several stones can be engaged against the workpiece either all at one time to speed up the grinding operation, or sequentially to create an incrementally smoother surface with finer grits.

The hydraulic centering of the shaft 3 on an annular liquid cushion ensures that it will be rotated virtually exactly about its center axis 3A, presuming the normal random distribution in surface irregularities, without any irregularities in the holder 2 being transmitted to the machined surface. At the same time there is minimal friction at the supports 2, while considerable axial clamping force can be exerted between the elements 19 to rotate the workpiece 3 with quite some torque.

Once the machining operation is complete the pump 16 can be shut off, the clamping elments 19 can be retracted, and the arms 6 opened to the horizontal position, redepositing the machined workpiece 3 on its support blocks 12. The conveyor 13 steps all the supports 12 downstream, and the operation can resume. Other holders 2 can be provided at further stations on the machine 1 for different operations, or holders 2 at different axial spacings can pick up the workpiece for finishing of those surfaces lying between the journal halves 4 during the preceding machining or grinding operation. Such other supports would have different inner diameters, for grabbing differently sized portions of the workpiece.

It is also possible to move the supports 2 along the machine 1 from station to station, to hold a picked-up workpiece in a succession of working stations where different tools will act on it.

Under any circumstances the method and apparatus of this invention work in such a manner that the workpiece is naturally held on its true center in such a manner that any localized surface irregularity will not cause it to be seriously misaligned in the holders and ground off true.

I claim:

1. A method of machining a workpiece having a generally cylindrical outer surface centered on an axis, the method comprising the steps of:

closing a pair of journal halves having generally semicylindrical inner surfaces of slightly greater diameter than the outer workpiece surface around the workpiece;

pumping a fluid under superatmospheric pressure into the space between the journal inner surface and the workpiece outer surface and thereby supporting the workpiece in the journal halves on the liquid generally out of contact with the inner surfaces thereof;

rotating the thus supported workpiece about its axis; and engaging a finishing tool radially against the workpiece.

2. The machining method defined in claim 1 wherein the average radial distance between the journal inner surface and workpiece outer surface when the journal halves are closed on the workpiece is equal to more than the sum of the radial deviations of these surfaces from a perfect cylinder.

3. The machining method defined in claim 1 wherein the superatmospheric pressure is generally at least 5 bar.

4. The machining method defined in claim 3 wherein the fluid is a machining oil.

5. The machining method defined in claim 1 wherein the workpiece is rotated by axially engaging it between a pair of rotatable elements and rotating at least one of the elements.

6. The machining method defined in claim 1, wherein the journal inner surfaces are centered on axes that are coaxial when the journal halves are closed together, and that are coaxial with the axis of the shaft when same is supported in them.

7. An apparatus for machining a workpiece having a generally cylindrical outer surface centered on an axis, apparatus comprising:

a pair of journal halves having generally semicylindrical inner surfaces of slightly greater diameter than the outer workpiece surface;

drive means for closing the halves around the outer surface of the workpiece;

means for pumping a fluid under superatmospheric pressure into the space between the journal inner surface and the workpiece outer surface and thereby supporting the workpiece in the journal halves on the liquid generally out of contact with the inner surfaces thereof;

means engageable with the workpiece for rotating the thus supported workpiece about its axis; and a finishing tool engageable radially against the workpiece.

8. The machining apparatus defined in claim 7 wherein the journal halves are substantially semicylindrical.

9. The machining apparatus defined in claim 7, further comprising:

respective arms supporting the journals and rotatable about at least one axis above the journal halves in the closed position thereof.

10. The machining apparatus defined in claim 9, further comprising supports underneath the arm axis holding the workpiece at a level with the workpiece axis slightly below the position of the centers of curvature of the journal halves, whereby when closed on the workpiece and pressurized the workpiece is lifted from the supports.

11. The machining apparatus defined in claim 7 wherein the journal halves are formed with radially throughgoing bores through which the fluid is fed.

* * * * *